US008539683B2

(12) United States Patent
Kuno

(10) Patent No.: US 8,539,683 B2
(45) Date of Patent: Sep. 24, 2013

(54) STAMPING MACHINE

(75) Inventor: Tsutomu Kuno, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 374 days.

(21) Appl. No.: 13/005,486

(22) Filed: Jan. 12, 2011

(65) Prior Publication Data

US 2011/0168039 A1 Jul. 14, 2011

(30) Foreign Application Priority Data

Jan. 13, 2010 (JP) ..... 2010-005310

(51) Int. Cl.
*B43L 13/00* (2006.01)
*B44B 5/00* (2006.01)

(52) U.S. Cl.
USPC ..... 33/18.1; 33/1 M; 101/3.1

(58) Field of Classification Search
USPC ..... 33/18.1, 1 M; 101/3.1
See application file for complete search history.

(56) References Cited

U.S. PATENT DOCUMENTS

| | | | | |
|---|---|---|---|---|
| 5,042,155 | A * | 8/1991 | Yoshioka et al. | 33/18.1 |
| 5,285,579 | A * | 2/1994 | Armando | 33/18.1 |
| 5,311,667 | A * | 5/1994 | Jambor | 33/18.1 |
| 5,368,400 | A * | 11/1994 | Cyphert et al. | 400/124.01 |
| 6,212,784 | B1 * | 4/2001 | Pittman | 33/18.1 |
| 6,460,257 | B1 * | 10/2002 | Shimotoyodome | 33/18.1 |
| 6,826,840 | B1 * | 12/2004 | Lindsey et al. | 33/18.1 |
| 7,191,529 | B2 * | 3/2007 | Phipps et al. | 33/18.1 |
| 8,336,214 | B2 * | 12/2012 | Kawaguchi et al. | 33/18.1 |
| 2003/0227494 | A1 * | 12/2003 | Therond | 346/141 |
| 2005/0086816 | A1 * | 4/2005 | Siegel | 33/18.1 |
| 2008/0295349 | A1 * | 12/2008 | Uhl et al. | 33/503 |

* cited by examiner

*Primary Examiner* — Christopher Fulton
(74) *Attorney, Agent, or Firm* — Lee, Hong, Degerman, Kang & Waimey

(57) ABSTRACT

An engraving device that forms a desired image via a plurality of engraved marks in a surface of an object via a working tool is presented. The engraving device includes a base comprising a retainer configured to retain the object, a X-direction displacement means located above the base, configured to displace the working tool along a X-axis along the surface of the object, a Y-direction displacement means located above the base, configured to displace the working tool along a Y-axis perpendicular to the X-axis along the surface of the object, and a Z-direction displacement means located above the base, configured to displace the working tool along a Z-axis toward and away from the object.

12 Claims, 4 Drawing Sheets

STAMPING MACHINE

CROSS-REFERENCE TO RELATED APPLICATIONS

Pursuant to 35 U.S.C. §119(a), this application claims the benefit of earlier filing date and right of priority to Japanese Patent Application No. 2010-005310, filed on Jan. 13, 2010, the contents of which is hereby incorporated by reference herein in its entirety.

BACKGROUND OF THE INVENTION

1. Field of the Invention

The present invention relates to an engraving device that forms an image on a surface of an object.

2. Discussion of the Related Art

In general, an engraving device forms an image on the surface of an object by engraving a plurality of marks on a surface of an object composed of a relatively formable material such as gold, platinum, brass, aluminum, or stainless steel. For example, an engraving device may form a desired image on an object by driving a tip of an engraving rod into a surface of an object to form a plurality of dot engraved marks in the surface of the object.

In prior art engraving devices, dust or other foreign matters generated during the engraving process would tend to enter a displacement mechanism, thereby making the maintenance of the displacement mechanism cumbersome.

The present invention has been made to overcome the above problem, and it is an object of the present invention to provide an engraving device that can reduce the burden of maintenance by preventing entrance of foreign matters into a displacement mechanism that displaces a working tool for engraving an object.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with an embodiment, an engraving device that forms a desired image via a plurality of engraved marks in a surface of an object via a working tool is presented. The engraving device includes a base comprising a retainer configured to retain the object, a X-direction displacement means located above the base, configured to displace the working tool along a X-axis along the surface of the object, a Y-direction displacement means located above the base, configured to displace the working tool along a Y-axis perpendicular to the X-axis along the surface of the object, and a Z-direction displacement means located above the base, configured to displace the working tool along a Z-axis toward and away from the object.

According to one feature wherein the Z-direction displacement means comprises a Z-direction feed screw that is provided along the Z-axis on the base, and a lifting element that is engaged with the Z-direction feed screw and movable along the Z-axis, and the X-direction displacement means and the Y-direction displacement means are provided on the lifting element.

According to another feature a space that is opened in at least one of the X-direction and the Y-direction is formed around the base.

According to yet another feature, the engraving device includes a control means configured to control the operations of the X-direction displacement means, the Y-direction displacement means and the Z-direction displacement means, wherein the control means is located above the base.

In accordance with another embodiment, an engraving device is presented. The engraving device includes a body, a first guide rod that is supported by the body and extends vertically, a lifting element that is movable vertically along the first guide rod, the lifting element comprising a second guide rod that extends in a longitudinal direction, a third guide rod that extends in a lateral direction, and a carriage that retains a working tool for engraving marks on a surface of an object, wherein a slide base is supported by the second guide rod or the third guide rod for movement on the guide rod in an axial direction thereof, and wherein the carriage is supported on the third guide rod for movement in an axial direction of the third guide rod.

These and other embodiments will also become readily apparent to those skilled in the art from the following detailed description of the embodiments having reference to the attached figures, the invention not being limited to any particular embodiment disclosed.

BRIEF DESCRIPTION OF THE DRAWINGS

The above and other aspects, features, and advantages of the present invention will become more apparent upon consideration of the following description of preferred embodiments, taken in conjunction with the accompanying drawing figures.

DETAILED DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
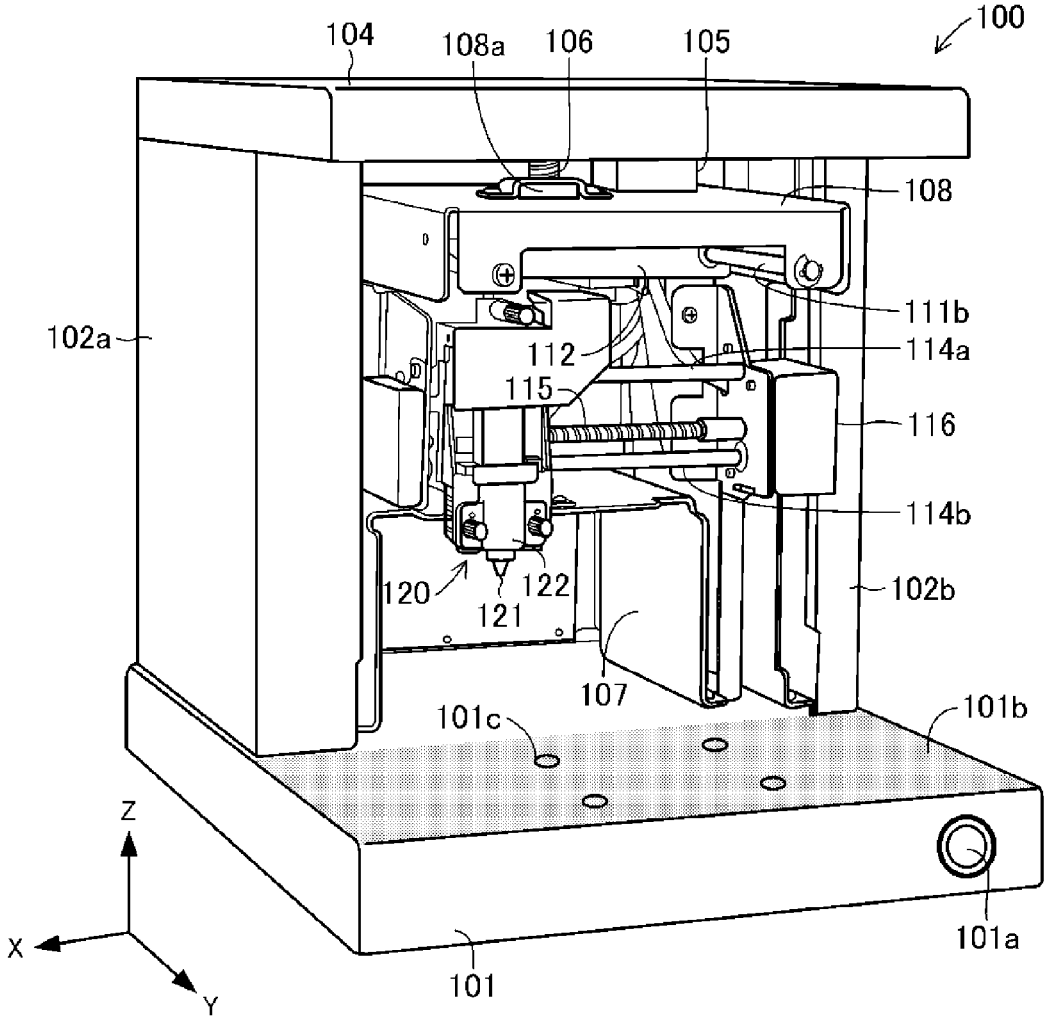
FIG. 1 is an external perspective view of an engraving device according to one embodiment of the present invention.
Figure 3:
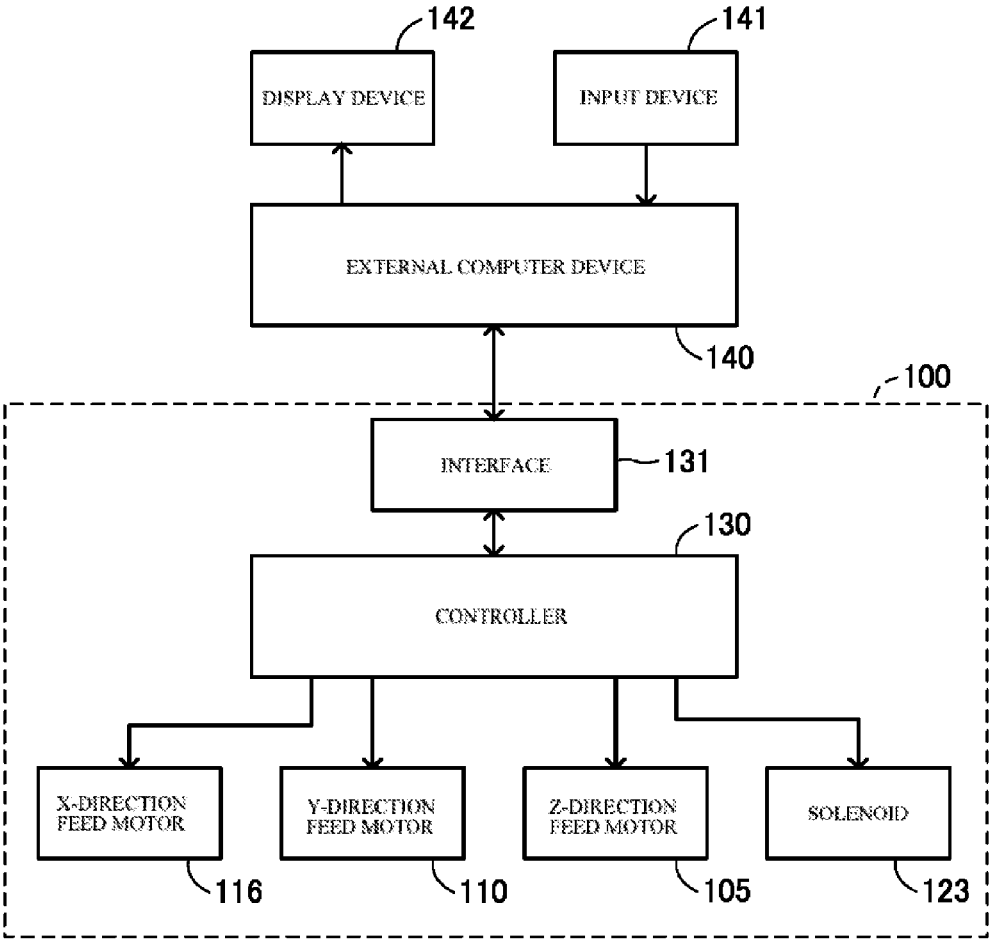
FIG. 3 is a block diagram of a control system that controls the operation of the engraving device according to one embodiment of the present invention.
Figure 4:
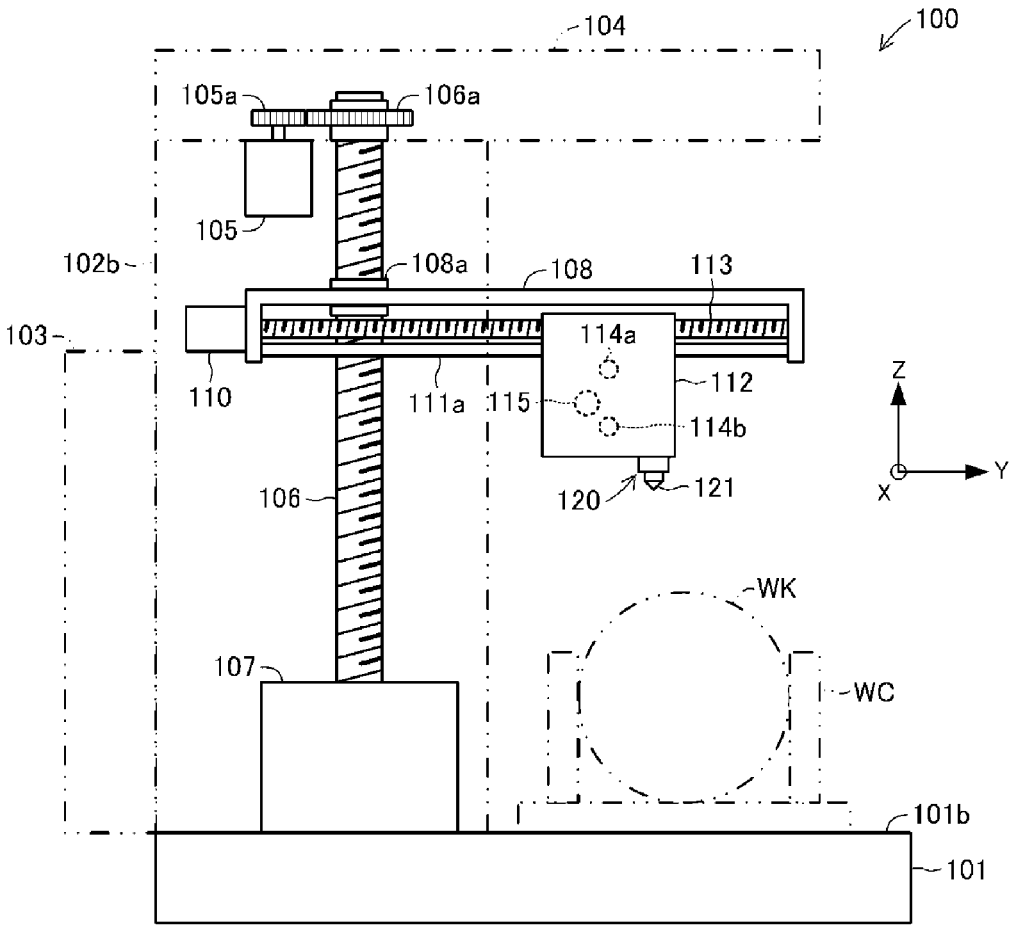
FIG. 4 is a schematic view illustrating the relationship of an X-direction displacement means and a Y-direction displacement means to a Z-direction displacement means in the engraving device according to one embodiment of the present invention.

It should be noted that the drawings used herein are schematically depicted to facilitate understanding of the present invention, for example, some elements may be exaggerated. Thus, the dimensions and proportions between constituent elements may be different. In addition, the lateral direction of the drawing, the depth direction of the drawing, and the vertical direction of the drawing are defined as X-direction, Y-direction, and Z-direction, respectively, as indicated by the coordinate axes that are shown in FIGS. 1, 3, and 4. The engraving device 100 is a processing device that forms a plurality of dot engraved marks in a surface of a workpiece WK to form a desired image in the surface of the workpiece WK.

As illustrated in FIG. 1, the engraving device 100 is provided with a base 101. The base 101, which carries and securely retains a workpiece WK as a target of engraving, may be formed by bending a plate into a rectangular box shape. The base 101 is provided with a power supply switch 101*a* for the engraving device 100 on its front face, and a workpiece positioning area 101*b* to receive a workpiece. At a central portion of the workpiece positioning area, four mounting holes 101*c* are provided for use in attaching a retainer WC for retaining the workpiece WK. Support pillars 102*a* and 102*b* are provided in an upright position at both ends of a surface of the base 101 behind the workpiece positioning area 101*b*.

The support pillars 102*a* and 102*b* may support a carriage 120 and are formed to extend in the Z-direction as illustrated in FIG. 1. A controller box 103 may be provided on the back side of the engraving device 100 (FIG. 2) and supported by the pillars 102*a* and 102*b*. At the upper ends of the support pillars 102*a* and 102*b*, a top frame 104 is provided across the support pillar 102*a* and support pillar 102*b*. As shown in FIG. 4, the top frame 104 is a box which may be formed of a plate and which supports upper ends of a Z-direction feed motor 105 and a Z-direction feed screw 106, and accommodates a driving gear 105*a* and a driven gear 106*a* that transmit the driving force of the Z-direction feed motor 105 to the Z-direction feed screw 106.

The Z-direction feed motor 105 is an electric motor, the operation of which is controlled by the controller 130, and rotatably drives the Z-direction feed screw 106. The Z-direction feed motor 105 is securely attached to a lower surface of the top frame 104 with its drive shaft extending into the top frame 104 through the bottom thereof. At the end of the drive shaft in the top frame 104, a driving gear 105*a*, which rotates together with the drive shaft, is attached.

The Z-direction feed screw 106 is a rod body, a spiral male thread with a trapezoidal cross-section is formed around the Z-direction feed screw 106, and is provided in an upright position in the Z-direction. One end of the Z-direction feed screw 106 extends into the top frame 104 through the bottom thereof, and the driven gear 106*a*, which meshes with the driving gear 105*a* of the Z-direction feed motor 105, is provided at the end. That is, the Z-direction feed screw 106 is coupled to the Z-direction feed motor 105 via the driving gear 105*a* and the driven gear 106*a*. The other end of the Z-direction feed screw 106 is rotatably supported by a pivotal support frame 107 provided on the base 101. The pivotal support frame 107 is a table that may be formed of a steel plate and provided in a protruded fashion on the base 101, which faces the top frame 104 from below.

Figure 2:
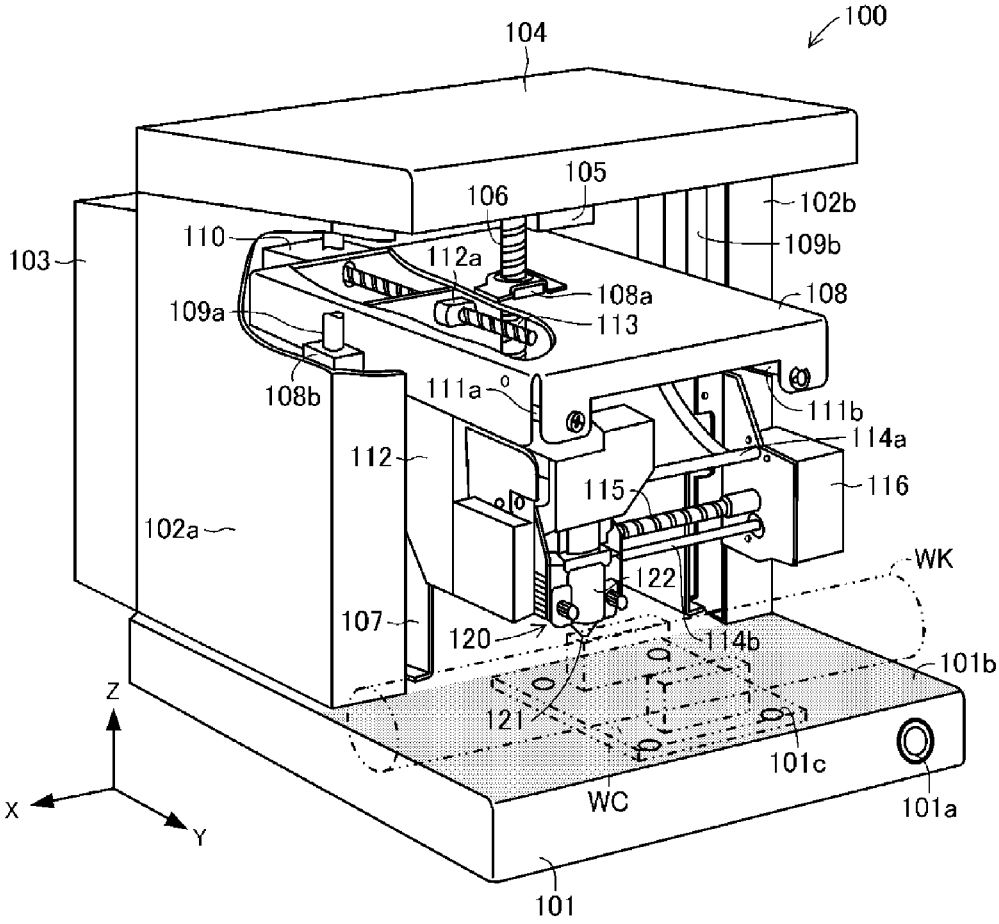
FIG. 2 is a partially cutaway perspective view of the engraving device illustrated in FIG. 1.

The Z-direction feed screw 106 is threaded with a feed nut 108*a* that is provided in a lifting base 108. The lifting base 108 is a plate-shaped body with sidewalls that are formed by bending the four sides of a flat plate downward, and is supported by the Z-direction feed screw 106 via the feed nut 108*a*, which extends through the lifting base 108 in the Z-direction. On each of the sidewalls of the lifting base 108, guide sleeves are provided, respectively. FIG. 2 illustrates a guide sleeve 108*b* attached to one sidewall of the lifting base 108.

The guide sleeves are cylindrical bodies through which guide shafts 109*a* and 109*b* slidably extend, respectively (FIG. 2), the guide sleeves are provided between the base 101 and the top frame 104 in an upright position. The lifting base 108 may be displaced up and down in the Z-direction along the guide shafts 109*a* and 109*b* by rotation of the Z-direction feed screw 106 via the Z-direction feed motor 105. A screw feed mechanism that is constituted on the Z-direction feed motor 105, the Z-direction feed screw 106, and the feed nut 108*a* correspond to a Z-direction displacement means.

In addition, a Y-direction feed motor 110 is provided on the sidewall of the lifting base 108. The Y-direction feed motor 110 is an electric motor, the operation of which is controlled by the controller 130, and rotatably drives a Y-direction feed screw 113. A slide base body 112 is supported inside of the sidewalls of the lifting base 108 via two guide shafts 111*a* and 111*b* (FIGS. 1 and 2). The guide shafts 111*a* and 111*b* are disposed parallel to each other in the Y-direction in the lifting base 108, and support the slide base body 112 for sliding movement in the Y-direction.

The slide base body 112 is a plate that supports the carriage 120, and has a plurality of sidewalls formed by bending a plate or joining plates. At an upper end of the slide base body 112, sidewalls are provided parallel to each other in the X-direction and in an upright position in the Z-direction. The guide shafts 111*a* and 111*b* slidably extend through the sidewalls. The Y-direction feed screw 113 extends via a feed nut 112*a* through a sidewall.

The Y-direction feed screw 113 is a spiral male thread rod with a trapezoidal cross-section and is provided horizontally in the Y-direction. One end of the Y-direction feed screw 113 is coupled to the Y-direction feed motor 110, and the male thread portion of the Y-direction feed screw 113 is threaded with the feed nut 112*a*, which is provided on the slide base body 112. Thus, the slide base body 112 is displaced in the Y-direction in the drawing along the guide shafts 111*a* and 111*b* by rotational driving of the Y-direction feed screw 113. A screw feed mechanism that is constituted on the Y-direction feed motor 110, the Y-direction feed screw 113, and the feed nut 112*a* correspond to a Y-direction displacement means.

Two guide shafts 114*a* and 114*b* and an X-direction feed screw 115 are provided between sidewalls extending parallel to each other in the Y-direction. The guide shafts 114*a* and 114*b* are provided parallel to each other and support the carriage 120 for sliding movement in the X-direction. The X-direction feed screw 115 is a spiral male thread rod with a trapezoidal cross-section and is provided horizontally in the X-direction. One end of the X-direction feed screw 115 is coupled to an X-direction feed motor 116, and the male threads portion of the X-direction feed screw 115 is threaded with a feed nut (not shown) provided in the carriage 120.

The X-direction feed motor 116 is an electric motor that rotatably drives the X-direction feed screw 115, and is securely provided on a sidewall of the slide base body 112. The operation of the X-direction feed motor 116 is controlled by the controller 130. The carriage 120 is displaced along the guide shafts 114*a* and 114*b* in the X-direction by rotational driving of the X-direction feed screw 115. A screw feed mechanism that is constituted on the X-direction feed motor 116, the X-direction feed screw 115, and a feed nut (not shown) provided in the carriage 120 correspond to an X-direction displacement means.

The elements that constitute the Y-direction displacement means and X-direction displacement means are attached to the lifting base 108 directly or via the slide base body 112. Thus, the Y-direction displacement means and X-direction displacement means are displaced up and down in the Z-direction with the lifting base 108 when the lifting base 108 is lifted up and down by the Z-direction displacement means.

The carriage 120 is a mechanical device which removably retains a generally needle-shaped working tool 121 that forms dot engraved marks on a surface of the workpiece WK and which vibrates the working tool 121 in a specific direction. Specifically, the carriage 120 has a generally cylindrical holder 122, a solenoid 123 (FIG. 3), and a spring (not shown) which are provided in the holder 122. The solenoid 123 is a cylindrical electromagnetic functional component that converts electrical energy into linear motion and thrusts the working tool 121 in a downward motion when energized. The driving of the solenoid 123 is controlled by the controller 130.

The spring is disposed below the solenoid 123, and pushes back the working tool 121 which is extended from the lower end of the solenoid 123. That is, the carriage 120 thrusts the working tool 121 downward by energizing the solenoid 123 and retracts the working tool 121 upward by de-energizing the solenoid 123 and using the biasing force of the spring. The working tool 121 is formed of a material which is harder than the workpiece WK, such as a cemented carbide alloy, a diamond, or an artificial diamond.

The controller 130 includes a microcomputer that includes components such as a CPU, a ROM, and a RAM, and controls the operations of the Z-direction feed motor 105, the Y-direction feed motor 110, the X-direction feed motor 116, and the solenoid 123 according to a command from an external computer device 140 that is connected to the controller 130 via an interface 131. The controller 130 is located in the controller box 103, which is provided on the back side of the engraving device 100 on the base 101.

The external computer device 140 (FIG. 3) includes a microcomputer that includes components such as a CPU, a ROM, a RAM, and a hard disk, and controls the operation of the engraving device 100 by executing a processing program (not shown) according to a command from an input device 141, such as a keyboard or a mouse. In this example, the processing program is stored in the hard disk. The external computer device 140 displays the operating conditions of the engraving device 100 and the execution status of the processing program on a display device 142. A personal computer (PC) is an example of the external computer device 140. It should be noted that the external computer device 140 may be any form of computer device which can control the operation of the engraving device 100.

The operation of the engraving device 100 will now be described. First, the operator connects the external computer device 140 and the engraving device 100 via the interface 131, and turns on the power supplies for the external computer device 140 and the engraving device 100. In this example, the operator activates various circuits of the engraving device 100 including the controller 130 by operating the power supply switch 101*a* provided on the front face of the base 101 of the engraving device 100. As a result, the external computer device 140 executes a prescribed program (not shown) and turns to a standby state to wait for a command from the operator.

The engraving device 100 may execute a prescribed program (not shown) that is stored in the ROM to return the carriage 120 to the origin position and then turns to a standby state to wait for a command from the external computer device 140. Next, the operator sets a workpiece WK in the workpiece positioning area 101*b* on the base 101 of the engraving device 100. In this example, the operator may use a retainer WC for use in securing the workpiece WK in the workpiece positioning area 101*b* on the base 101. The workpiece WK can be set on the base 101 without regard to the length thereof. That is, a workpiece WK with a various shape can be set on the base 101 by placing the workpiece WK with its longitudinal direction matching the X-direction on the base 101.

Next, the operator operates the input device 141 of the external computer device 140 to command the external computer device 140 to execute a processing program (not shown). The processing program is a program that creates processing data corresponding to a desired image and outputs the data to the engraving device 100 in order to form a desired image in a surface of the workpiece WK. In response to this command, the external computer device 140 executes the processing program.

Specifically, the external computer device 140 prompts the operator to input image data. In response, the operator inputs a desired image into the external computer device 140 via an image capture device such as a scanner. As a result, image data representing the desired image is stored in the memory of the external computer device 140. In this example, the image data may be in a raster data format. Alternatively, the operator may create an image on the external computer device 140 via an image drawing software. The image data may be in a vector format such as outlines of letters.

Next, the external computer device 140 creates engraving process data based on the image data. The engraving process data is data which operates the engraving device 100 in order to form dot engraved marks on a surface of the workpiece WK. In this example, the external computer device 140 creates the engraving process data based on the degree of luminosity of black and white included in the image data. That is, the engraving process data is created to form engraved marks with different depths that correspond to different degrees of luminosity of black and white that are included in the image data. The depths of the engraved marks represent the degrees of shading of the image that is formed on the workpiece WK.

The external computer device 140 then outputs the engraving process data to the engraving device 100. The engraving device 100 temporarily stores the engraving process data that has been output from the external computer device 140 in the RAM of the controller 130, and controls the operations of the Z-direction feed motor 105, the Y-direction feed motor 110, the X-direction feed motor 116, and the solenoid 123 based on the temporarily stored engraving process data.

Specifically, the controller 130 controls the operation of the solenoid 123 to drive the tip of the working tool 121 into the surface of the workpiece WK intermittently while controlling the operations of the Z-direction feed motor 105, the Y-direction feed motor 110, and the X-direction feed motor 116 to change the position of the end of the working tool 121 relative to the workpiece WK. In this example, the carriage 120 is displaced in the Z-direction together with the lifting base 108 in accordance with the vertical displacement thereof and is displaced in the Y-direction and X-direction by driving the Y-direction feed motor 110 and the X-direction feed motor 116. As a result, an image is formed on the surface of the workpiece WK, the image comprising a multiplicity of engraved marks.

In this example, X-direction displacement refers to the X-direction feed motor 116, the X-direction feed screw 115, and the feed nut provided in the carriage 120. Y-direction displacement means refers to the Y-direction feed motor 110, the Y-direction feed screw 113, and the feed nut 112*a*. Z-direction displacement means refers to the Z-direction feed motor 105, the driving gear 105*a*, the Z-direction feed screw 106, the driven gear 106*a*, and the feed nut 108*a*. Accordingly, the X-direction displacement means, the Y-direction displacement means, and the Z-direction displacement means prevent the dust that is generated during processing of the workpiece WK from entering the respective components.

The image on the workpiece WK is formed by the working tool 121, which is displaced relative to the workpiece WK in a stationary state. Thus, the engraving device 100 does not require a mechanical structure that is used to displace a large workpiece WK and can reduce errors in processing accuracy which are caused by displacing a large workpiece WK. When the processing based on the engraving process data is fully completed, the controller 130 returns the carriage 120 to the position of origin.

Accordingly, when the external computer device 140 stops executing the processing program and returns to a standby state, the engraving device 100 also returns to a standby state. The operator may then remove the workpiece WK from the base 101 and finish the processing work. When the image is formed on another workpiece WK, the operator sets the other workpiece WK on the base 101 and executes the processing program.

As can be understood from the above description of operation, according to the above embodiment, the X-direction displacement means, Y-direction displacement means, and Z-direction displacement means displace the working tool 121 relative to the workpiece WK in three axial directions along the X, Y, and Z, axis, respectively. Thus, the dust that is generated during processing of a workpiece WK is unlikely to enter the components that constitute the X-direction displacement means, Y-direction displacement means, and Z-direction displacement means. As a result, the burden of maintenance of the X-direction displacement means, Y-direction displacement means, and Z-direction displacement means, is reduced. In addition, preventing the entrance of foreign matter into the X-direction displacement means, Y-direction displacement means, and Z-direction displacement means also reduces errors in processing accuracy.

It should be noted that the present invention is not limited to the above embodiments and various modification may be mode without departing from the object of the present invention.

For example, in the embodiment described above, each of the X-direction displacement means, Y-direction displacement means, and Z-direction displacement means includes a screw feed mechanism. However, the X-direction displacement means, Y-direction displacement means, and Z-direction displacement means are not necessarily limited to the above embodiment as long as the carriage 120 can be displaced along the X, Y, and Z axis. For example, a displacing object, such as the carriage 120 or the slide base body 112, may be displaced by coupling a belt or wire that is wound around a pulley to the displacing object and driving the pulley with a feed motor.

In the above embodiment, the engraving device 100 is configured to form an open space, in the X-direction, above the workpiece positioning area 101*b* on the base 101. However, the engraving device 100 may be configured to form an open space, in the Y-direction, above the workpiece positioning area 101*b* on the base 101. When there is no need to process a large workpiece WK, the engraving device 100 does not need to be configured to form the open spaces in the X-direction and Y-direction above the workpiece positioning area 101*b*.

In the above embodiment, the controller 130 is disposed in the controller box 103, which is provided on the back side of the engraving device 100 above the base 101. This prevents the dust that is generated during processing of a workpiece WK from attaching to the controller 130. However, the controller 130 may also be protected from dust by, for example, placing it a box. In other words, the controller 130 may be located in the base 101, for example.

While the engraving process data is created by the external computer device 140 in the above embodiment, the present invention is not limited to creating process data in the external computer device 140. For example, the engraving device 100 may be provided with an input device or a display device and the processing program may be stored in the RAM or ROM of the controller 130 so that the engraving process data can be created based on a desired image. That is, the engraving device 100 may be provided with a function of creating engraving process data. In this example, the external computer device 104 is unnecessary.

In the above embodiment, the lifting base 108 that is displaced in the Z-direction by driving of the Z-direction feed motor 105 is provided with the Y-direction displacement means and X-direction displacement means separately. Specifically, the lifting base 108 corresponds to a lifting element. The shape and size of the lifting base 108 is not limited to the above embodiment, and may be determined appropriately depending on the Y-direction displacement means, X-direction displacement means, and the carriage 120 which are attached thereto. In addition, the engraving device 100 may be constructed without the lifting base 108. For example, Z-direction displacement means and X-direction displacement means may be attached to a Y-direction displacing element, which corresponds to the lifting base 108 that is displaced in the Y-direction by the Y-direction feed motor 110.

The foregoing embodiments and advantages are merely exemplary and are not to be construed as limiting the present invention. The present teaching can be readily applied to other types of apparatuses and processes. The description of the present invention is intended to be illustrative, and not to limit the scope of the claims. Many alternatives, modifications, and variations will be apparent to those skilled in the art.

What is claimed is:

1. An engraving device that forms a desired image via a plurality of engraved marks in a surface of an object via a working tool, the engraving device comprising:

a base comprising a retainer configured to removably retain the object;

a carriage disposed above the base, the carriage configured to removably retain the working tool such that a portion of the working tool extends from an underside of the carriage towards the base;

an X-direction displacement means for displacing the carriage along an X-axis, wherein the X-direction displacement means is disposed entirely above the underside of the carriage;

a Y-direction displacement means for displacing the carriage along a Y-axis perpendicular to the X-axis, wherein the Y-direction displacement means is disposed entirely above the underside of the carriage;

a Z-direction displacement means for displacing the carriage along a Z-axis toward and away from the base, wherein the Z-direction displacement means is disposed entirely above the underside of the carriage; and a support structure connected to the base, the support structure configured to support the X-direction displacement means, the Y-direction displacement means, and the Z-direction displacement means above the base.

2. The engraving device according to claim 1, wherein the Z-direction displacement means comprises a Z-direction feed screw that is provided along the Z-axis on the support structure, and a lifting element that is engaged with the Z-direction feed screw and movable along the Z-axis, and wherein the X-direction displacement means and the Y-direction displacement means are provided on the lifting element.

3. The engraving device according to claim 2, wherein the support structure is further configured to provide an open space that extends from the retainer to a distal edge of the base along at least the X-axis or the Y-axis.

4. The engraving device according to claim 1, wherein the support structure is further configured to provide an open space that extends from the retainer to a distal end of the base along at least the X-axis or the Y-axis.

5. The engraving device according to claim 4, further comprising:

a control means configured to control the X-direction displacement means, the Y-direction displacement means, and the Z-direction displacement means, wherein the control means is disposed above the base.

6. The engraving device according to claim 1, further comprising:

a control means configured to control the X-direction displacement means, the Y-direction displacement means, and the Z-direction displacement means, wherein the control means is disposed above the base.

7. An engraving device comprising:

a base;

a drive system that drives a first drive member, a second drive member, and a third drive member;

a lifting assembly connected to the first drive member such that the first drive member moves the lifting assembly vertically when the drive system drives the first drive member, the lifting assembly comprising the second drive member, a slide member connected to the second drive member such that the second drive member moves the slide member in a first direction perpendicular to the vertical direction when the drive system drives the second drive member, the third drive member, a carriage disposed above the base, the carriage connected to the slide member such that the carriage moves along with the slide member in the first direction, the carriage further connected to the third drive member such that the third drive member moves the carriage in a second direction perpendicular to the first direction and perpendicular to the vertical direction when the third drive member is driven by the drive system, the carriage configured to removably retain a working tool such that a portion of the working tool configured for engraving extends from an underside of the carriage towards the base, wherein the first drive member and the lifting assembly are disposed entirely above the underside of the carriage; and a support structure connected to the base, the support structure configured to support the first drive member and the lifting assembly above the base.

8. The engraving device according to claim 7, wherein the base includes a retaining portion to removably retain an object, the first drive member is disposed above a rear part of the base, the retaining portion is disposed on a front part of the base, and the drive system drives the first, second, and third drive members to move the working tool along the first, second, and vertical directions above the retaining portion.

9. The engraving device according to claim 7, wherein the drive system comprises a first motor disposed on the lifting assembly, the first motor configured to drive the second drive member, and a second motor disposed on the lifting assembly, the second motor configured to drive the third drive member.

10. The engraving device according to claim 7, wherein the slide member is supported by the second drive member, and the carriage is supported by the slide member.

11. The engraving device according to claim 10, wherein the third drive member is disposed below the second drive member.

12. The engraving device according to claim 11, wherein the third drive member extends along the second direction beyond distal ends of the second drive member.

* * * * *